COUNTING SECTION SHIELDING DEVICE FOR PAPER SHEET COUNTING MACHINE

BACKGROUND OF THE INVENTION

Field of the Invention

The present invention relates generally to a paper sheet counting machine, and more particularly to a counting section shielding device for use with the paper sheet counting machine.

SUMMARY OF THE INVENTION

It is an object of the present invention to provide a counting section shielding device for use with a paper sheet counting machine of the type, in which paper sheets to be counted are held by a paper holder so that they may be counted by means of rotary suction cylinders and in which a comparator is provided to compare the actual counted number with a preset number.

Another object of the present invention is to provide a counting section shielding device of the above type, which is equipped with a pair of double-leaf type sound-proof covers which can be closed, after the paper holder is charged with the paper sheets, so that the paper sheets can be counted safely and reliably, shielded to prevent escape of noise and dust.

A further object of the present invention is to provide a counting section shielding device of the above type, in which the paper holder and the sound-proof covers are automatically opened to provide easy access to the inside of the counting section in case the actual counted number is equal to the preset number, so that the paper sheets can be smoothly taken out of the paper holder, whereby the operator is able to confirm from the automatic opening of the sound-proof covers that the count is proper.

A still further object of the present invention is to provide a counting section shielding device of the above type, in which the paper holder and the sound-proof covers are left closed in case the two numbers are found unequal but can be opened by the manual operation of a resetting button, whereby the operator is able to confirm a problem in the count.

A still further object of the present invention is to provide a counting section shielding device of the above type, in which the counting operations can be accomplished with sufficient confirmation.

According to a major feature of the present invention, there is provided a counting section shielding device for use with a paper sheet counting machine comprising: a counting section including a paper holder made movable between an open stand-by position in which the machine is ready to receive paper sheets for counting and a closed holding position for holding the paper sheets, a rotatable suction drum, and a plurality of rotatable suction cylinders carried on said suction drum for sucking the paper sheets one by one so as to count the number of the same; and a comparator for comparing the actual counted number with a preset number, said counting section shielding device comprising: a pair of double-leaf type sound-proof covers made movable between an open position for providing easy access to said counting section and a closed position in which the shielding device extends above said counting section so as to shield the same to prevent escape of noise and dust; an electric circuit for generating closing signals after said paper holder is charged with the paper sheets and for generating opening signals in case that the comparison by said comparator shows the counted number to be equal to the preset number but not in case that the comparison shows said numbers to be unequal, said electric circuit including a resetting button made manually operable for generating the opening signals of said electric circuit; and drive means made responsive to both the closing signals of said electric circuit for closing said sound-proof covers and the opening signals of the same for opening said sound-proof covers as well as said paper holder.

BRIEF DESCRIPTION OF THE DRAWINGS

Other objects and advantages of the present invention will become apparent from the following description taken in conjunction with the accompanying drawings, in which.

DESCRIPTION OF THE PREFERRED EMBODIMENT

Figure 3:
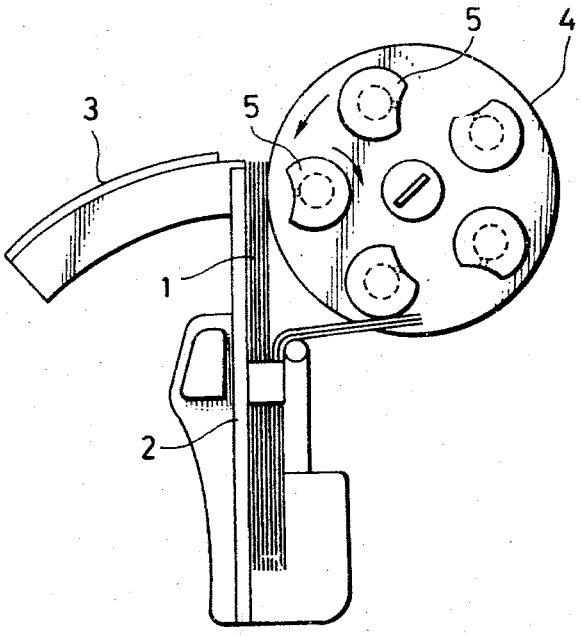
FIG. 3 is a partially cut-away front elevation showing the portion of the paper sheet counting machine of FIG. 2.
Figure 1:
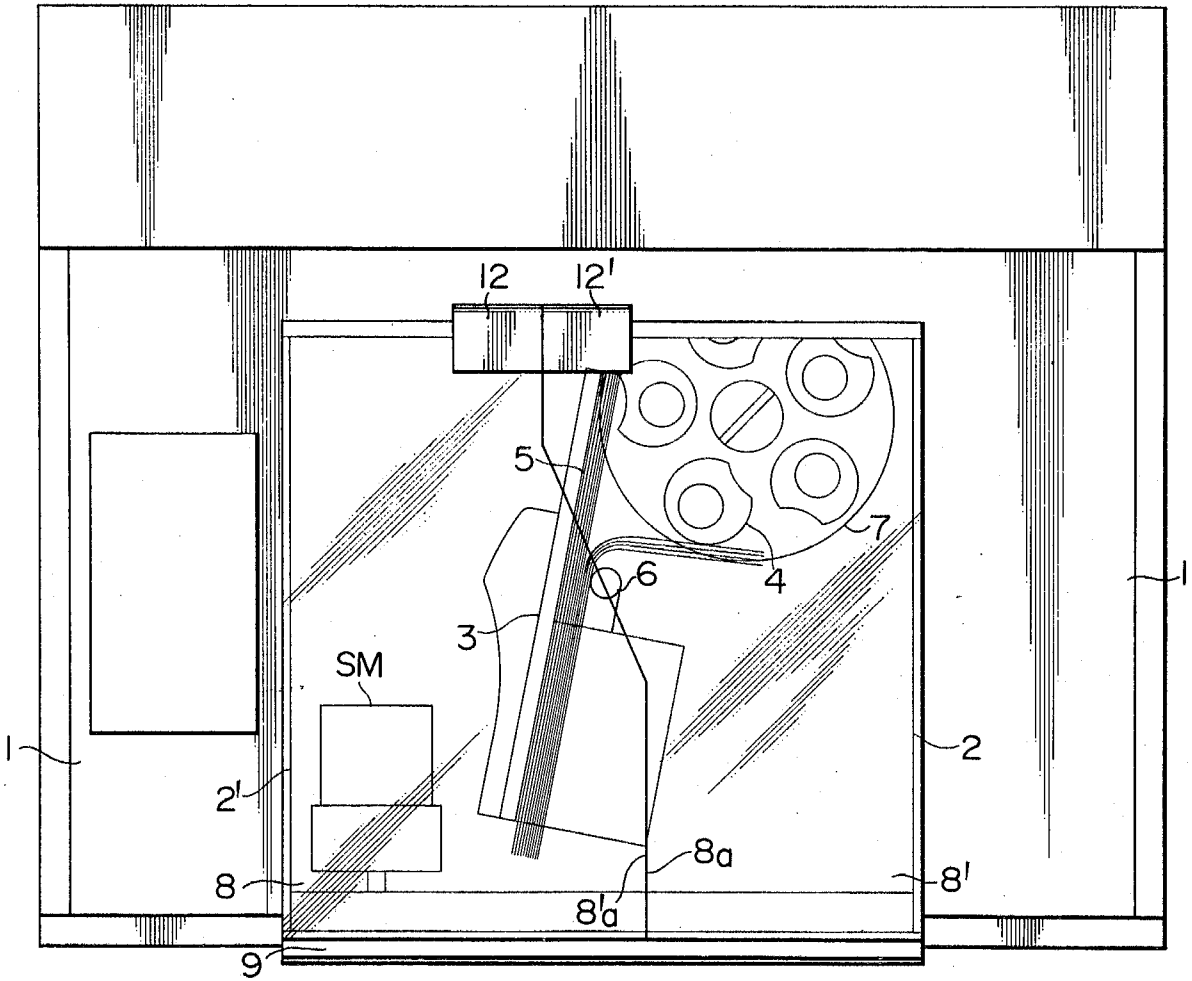
FIG. 1 is a top plan view showing a paper sheet counting machine for use with a counting section shielding device according to the present invention.
Figure 2:
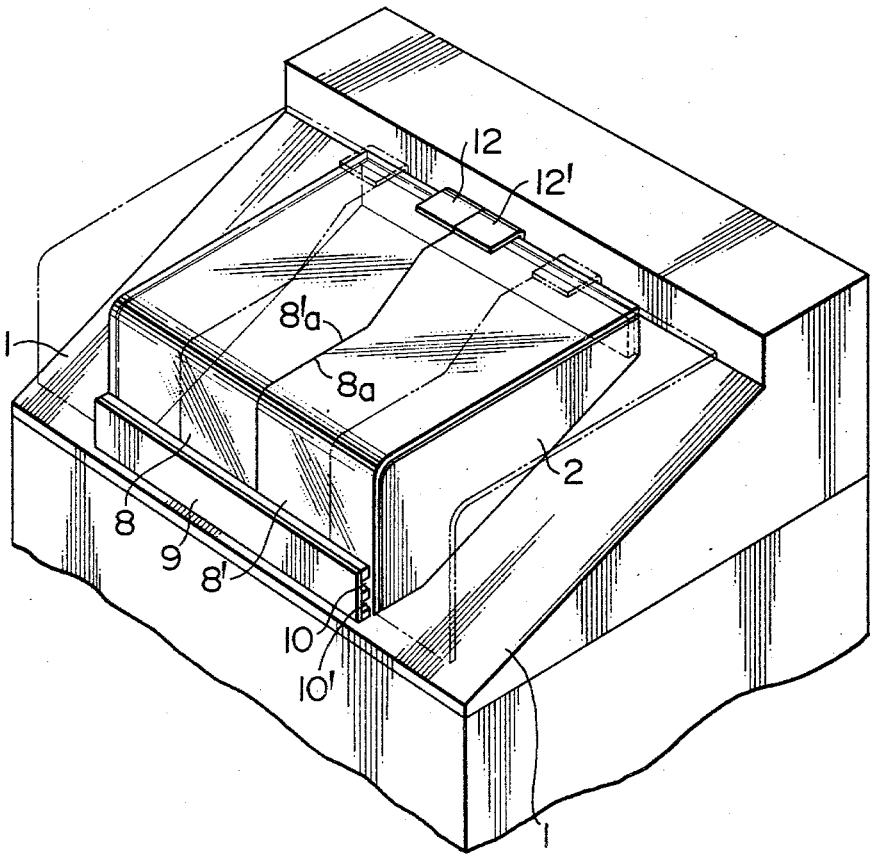
FIG. 2 is a perspective view showing a portion of the paper sheet counting machine of FIG. 1.
Figure 3:
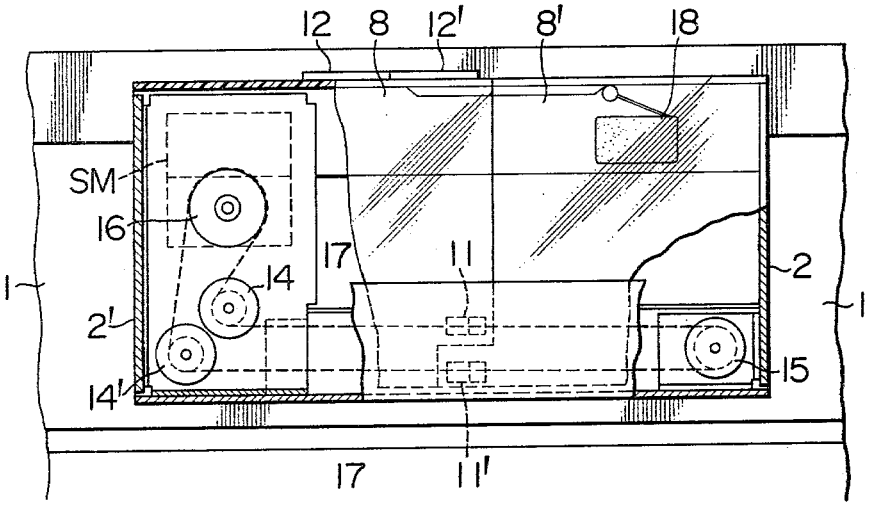
Figure 4:
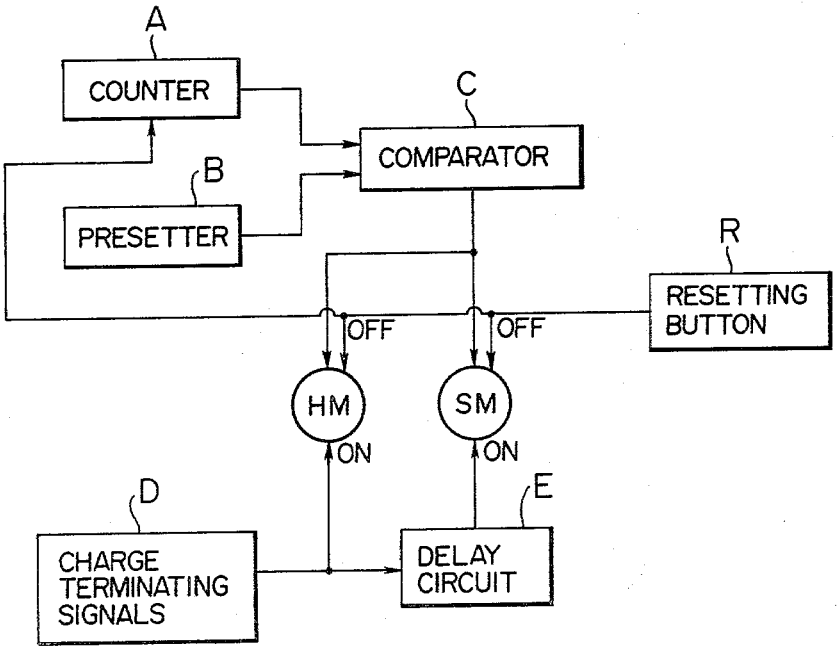

The present invention will now be described with reference to the accompanying drawings. Referring first to FIGS. 1, 2 and 3, the construction of a paper sheet counting machine according to the present invention will be explained. As shown, an upper slope 1 is partially removed to form an opening, which is equipped with a pair of side plates 2 and 2' one at either side. A counter section including a paper holder 3 and a plurality of suction cylinders 4 is arranged inside the opening at its lower bottom. The paper holder 3 is made swingable from a charging position, in which it is charged with a bundle of paper sheets 5, to a counting position, in which it holds the paper sheets 5 so that the latter may be counted, as better seen in FIG. 5. The suction cylinders 4 are rotatably mounted on a rotary suction drum 7 so that the paper sheets 5 can be sucked and peeled one by one by the action of the suction cylinders 4, while being held on a holding rod 6, so that they may be counted. The construction of the paper sheet counting machine thus described is of known type, and accordingly a detailed discussion will be omitted here.

According to the present invention, there are arranged above the opening of the slope 1 a pair of sound-proof covers 8 and 8' which are made of a transparent material and which are of the so-called "double-leaf" type. If the sound-proof covers 8 and 8' are closed until their inside edges 8*a* and 8*a*' abut against each other, they cover the paper holder 3 and the suction cylinders while preventing the escape of noise and dust. For these operations, the sound-proof covers 8 and 8' are equipped with slide members 11 and 11', which are made slidable sideways along the upper and lower rails 10 and 10'. These rails 10 and 10' are attached to the inner wall of a guide 9 which in turn is fixed at the lower front portions of the two covers 8 and 8'. Moreover, a pair of supporting plates 12 and 12' is fixed to the rear portions of the sound-proof covers 8 and 8' and are equipped at its inside with rollers not shown which are fitted in a sidewise guide 13. As a result, the two sound-proof covers 8 and 8' act as double leaves which can be moved sideways so that they may be opened and closed.

With reference to FIG. 3, a pair of pulleys 14 and 14' are journaled at the left-hand side of the guide 9 whereas another pulley 15 is journaled at the right-hand side of the same. A chain 17 is made to run on those pulleys 14, 15 and 14' and the pulley 16 of a shielded motor SM. Moreover, the slide members 11 and 11' are carried on the chain 17 at its upper and lower sideway portions. As a result, then the shileded motor SM is energized, the sound-proof covers 8 and 8' can be moved in the opposite directions. There is also provided at an upper position a position detecting switch 18 which is made operative to detect the limit positions for the opening and closing operations of the covers 8 and 8' thereby to stop the shielded motor SM at those limit positions.

Figure 4:
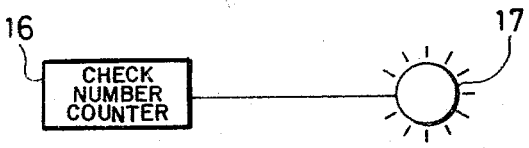
FIG. 4 is a block diagram showing an electric circuit for controlling the operations of the counting section shielding device of FIGS. 1 to 3.

Turning now to FIG. 4, there is shown in a block diagram an electric circuit which is to be used with the paper sheet counting machine according to the present invention. As shown, reference letter A designates a counter for counting the number of the paper sheets 5. Letter B designates a presetter for setting a predetermined number. Letter C designates a comparator, whereas letter E designates a delay circuit. Letter D designates charge terminating signals which are generated when the paper holder 3 is charged with the paper sheets 5. Letters HM designate a holder motor for driving the paper holder 3. Letter R designates a resetting button.

Figure 5:
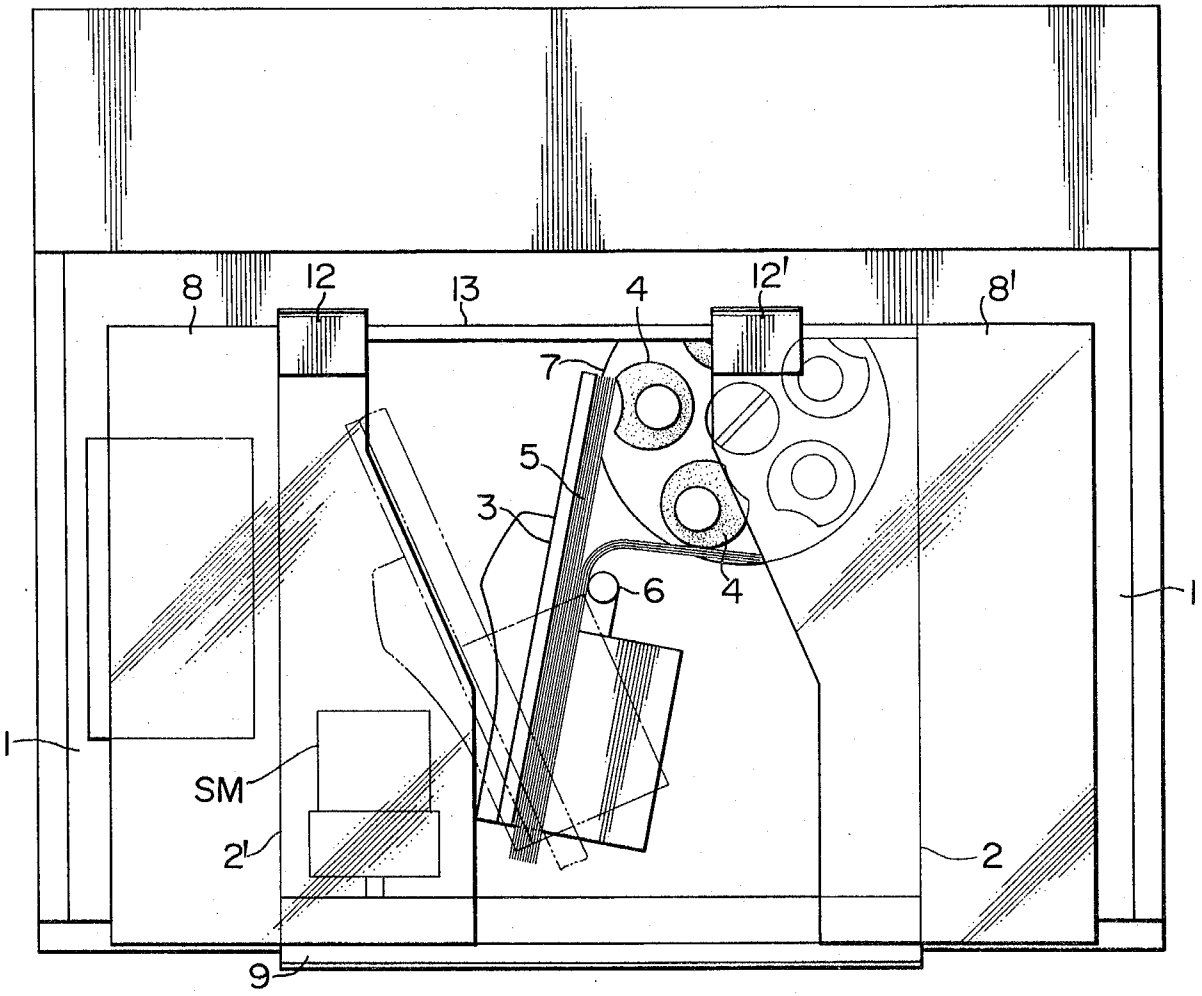
FIG. 5 is similar to FIG. 1 but explains the operations of the counting section shielding device with its sound-proof covers opened.

The operations of the so constructed paper sheet counting machine will be described in the following. Consideration is first given to the condition wherein the two sound-proof covers 8 and 8' are positioned at their left- and right-hand extremities, as shown in double-dotted lines in FIG. 2 and in broken lines in FIG. 5. If, in this condition, the paper holder 3, which is opened as shown in double-dotted lines in FIG. 5, is charged with the paper sheets 5, this charge is detected by means of a start detecting switch (not shown) in a similar manner to the conventional machine so that the charge terminating signals D are generated, as seen from FIG. 4. As a result, the holder motor H is energized to start its rotations. With a delay predetermined by the delay circuit E, the shielded motor SM is also energized to start its rotations. As a result, the chain 17 is driven to move the slide members 11 and 11' in the opposite directions so that the two covers 8 and 8' are moved toward each other until their inner edges 8*a* and 8*a'* abut against each other. At these abutting positions, the shielded motor SM is stopped by the action of the position detecting switch 18 so that the upper portion of the counting section is shielded with the two sound-proof covers 8 and 8' while preventing the escape of noise and dust. By the rotations of the holder motor HM, on the other hand, the paper sheets 5 are brought into contact with the suction cylinders 4 until the holder motor HM is stopped. Thus, the paper sheets 5 are sucked one by one by the respective suction cylinders 4 so that their number can be counted. After these counting operations, the counted result is fed to the comparator C so that it may be subjected to comparison with a preset number. In case the counted number is found equal to the preset number, the comparator C generates coincidence signal so that both the holder motor HM and the shielded motor SM are turned in their opening directions. As a result, the paper holder 3 and both sound-proof covers 8 and 8' are opened to provide easy access to the paper sheets 5 so that these paper sheets 5 can be taken out of the paper holder 3 as they are.

After the counting operations, on the contrary, if the counted number is not equal to the preset number so that no coincidence signal is generated from the comparator C, then both the holder motor HM and the shielded motor SM are left unenergized in their closed conditions so that the sound-proof covers 8 and 8' are left closed. If, in this case, the resetting button R is depressed, the memory of the counter A is cleared, and at the same time both the holder motor HM and the shielded motor SM are energized. As a result, the paper holder 3 and both covers 8 and 8' are opened so that the paper sheets 5 can be taken out of the paper holder 3.

As has been described hereinbefore, the paper sheet counting machine to be improved by the present invention is of the type in which the paper sheets can be held by the paper holder and can be counted by the suction cylinders, in which the counting section including the holder and the cylinders can be shielded with the double-leaf type sound-proof covers, and in which the comparator is provided to compare the counted number with the preset number. According to the present invention, the sound-proof covers are closed to make the counting operations possible after the paper holder is charged with the paper sheets. Moreover, in case the comparator finds the counted number and the preset number to be equal, the sound-proof covers are opened together with the paper holder. If, on the contrary, the numbers are found to be unequal, the paper holder and the sound-proof covers are left closed, but they can be released and opened by the depression of the resetting button of the electric circuit. Thanks to the above construction, the sound-proof covers are closed after the charging operation of the paper sheets so that these sheets can be counted safely and reliably while preventing the escape of noise and dust. If the counted number is found equal to the preset number, the paper holder and the sound-proof covers are automatically opened, so that he can take out the peper sheets smoothly without any difficulty and from the fact that the sound-proof covers opened automatically the operator is able to confirm that the count is proper. In the unequal case, on the contrary, the paper holder and the sound-proof covers are left closed, a fact which allows the operator to confirm that the count is improper, and by depressing the resetting button he can open the paper holder and the covers. As a result, he can also take out the paper sheets so as to shoot the troubles, if any. In these ways, according to the present invention, the counting operations can be accomplished with sufficient confirmation but without any error.

What is claimed is:

1. In a paper sheet counting machine comprising: a counting section including a paper holder made movable between an open stand-by position in which the machine in ready to receive paper sheets for counting and a closed holding position for holding the paper sheets, a rotatable suction drum, and a plurality of rotatable suction cylinders carried on said suction drum for sucking the paper sheets one by one so as to count the number of the same; and a comparator for comparing the actual counted number with a preset number, a counting section shielding device comprising: a pair of double-leaf type sound-proof covers made movable between an open position for providing easy access to said counting section and a closed position in which the shielding device extends above said counting section so as to shield the same and prevent the escape of noise and dust; an electric circuit for generating closing signals after said paper holder is charged with the paper sheets and for generating opening signals when the comparison by said comparator shows the counted number to be equal to the preset number but not when the comparison shows said numbers to be unequal, said electric circuit including a resetting button made manually operable for generating the opening signals of said electric circuit; and drive means made responsive to both the closing signals of said electric circuit for closing said sound-proof covers and the opening signals of the same for opening said sound-proof covers as well as said paper holder.

2. A counting section shielding device according to claim 1, wherein said drive means includes a holder motor made coactive with said comparator and the resetting button of said electric circuit for bringing said paper holder into the open stand-by position and into the closed holding position, a shielded motor made coactive with said comparator and said resetting button, and a power train made to run by said shielded motor for bringing said sound-proof covers into the open position and into the closed position.

3. A counting section shielding device according to claim 1, further comprising guide means for guiding the movements of said sound-proof covers.

4. A counting section shielding device according to claim 1, wherein said electric circuit includes delay means made responsive to the termination of the charging operation of said paper holder for effecting the operation bringing said sound-proof covers into the closed position with a preset delay after the operation bringing said paper holder into the closed holding position.

* * * * *